US005992286A

United States Patent [19]

Boole

[11] Patent Number: 5,992,286

[45] Date of Patent: Nov. 30, 1999

[54] APPARATUS FOR OPENING COIN WRAPPERS

[76] Inventor: Leon Boole, P.O. Box 31, Newtonville, Mass. 02160

[21] Appl. No.: 08/800,398

[22] Filed: Feb. 14, 1997

[51] Int. Cl.[6] ..... B24B 7/00

[52] U.S. Cl. ..... 83/856; 30/280; 30/294; 83/924

[58] Field of Search ..... 30/2, 280, 294; 83/856, 924

[56] References Cited

U.S. PATENT DOCUMENTS

| | | | |
|---|---|---|---|
| 853,969 | 5/1907 | Goebler | 83/924 X |
| 1,919,907 | 7/1933 | Robinson | 30/2 |
| 2,050,768 | 8/1936 | Seymour | 30/2 |
| 2,234,013 | 3/1941 | Stover | 30/2 X |
| 2,241,995 | 5/1941 | Holmes | 30/2 |
| 2,255,945 | 9/1941 | Shuler | 30/294 |
| 2,573,381 | 10/1951 | Arnold | 30/2 |
| 2,621,659 | 12/1952 | Greene | 30/294 X |
| 3,667,122 | 6/1972 | Black . | |
| 3,781,987 | 1/1974 | Gentscheff . | |
| 3,802,446 | 4/1974 | Pilat . | |
| 3,821,917 | 7/1974 | Hatanaka . | |
| 3,830,142 | 8/1974 | Ristvedt et al. . | |
| 3,831,783 | 8/1974 | Pilat . | |
| 3,898,733 | 8/1975 | Cormier | 30/294 X |
| 3,905,176 | 9/1975 | Ushio . | |
| 3,906,964 | 9/1975 | Ushio . | |
| 3,908,338 | 9/1975 | Ushio . | |
| 3,908,525 | 9/1975 | Ristvedt et al. . | |
| 3,965,575 | 6/1976 | Stunger . | |
| 4,001,934 | 1/1977 | Bell | 30/294 X |
| 4,038,746 | 8/1977 | Bromley . | |
| 4,040,183 | 8/1977 | Cassier . | |
| 4,086,698 | 5/1978 | Sparks . | |
| 4,091,537 | 5/1978 | Stevenson, Jr. . | |
| 4,106,196 | 8/1978 | Smithline . | |
| 4,136,501 | 1/1979 | Connolly . | |
| 4,138,834 | 2/1979 | Nobuhiro . | |
| 4,148,170 | 4/1979 | Gaubert . | |
| 4,148,238 | 4/1979 | Mortenson et al. . | |
| 4,153,054 | 5/1979 | Boone . | |
| 4,165,595 | 8/1979 | Pilley et al. . | |
| 4,170,305 | 10/1979 | Hull, Jr. et al. . | |
| 4,332,234 | 6/1982 | Smith et al. . | |
| 5,123,320 | 6/1992 | Hochfeld | 83/856 |

*Primary Examiner*—M. Rachuba
*Attorney, Agent, or Firm*—Maureen Stretch

[57] ABSTRACT

Coin wrapper opening apparatus that has a surface with a curved or angled cutting edge fixed to it so that the cutting edge faces away from the surface and projects away from it at a height effective to score or cut the wrapper of a wrapped roll of coins, when brought into cutting relationship with the roll. In several embodiments the surface also includes a guidepath to guide wrapped rolls to the cutting edge. In one embodiment, the cutting edge is shielded by a resilient flap that pushes up and away when a wrapped coin roll passes the cutting edge, and the flap then returns to its original shielding position when the roll is removed. In other embodiments, the cutting edge is shielded by a resilient strip fixed over the cutting edge so that the resilient strip stands away from the cutting edge with no pressure on it, and the resilient strip deforms to allow the cutting edge to pass through an aperture when the apparatus is placed against a wrapped coin roll. Alternatively, a combination of shields can be used: a resilient flap fitting over the cutting edge from the edge of the surface and a resilient strip fitting over the cutting edge from another area of the surface, as well. Also alternatively, a pair of wings with a spring mechanism could be used so that they part when a wrapped coin roll is placed in cutting relationship and cover the cutting edge again when the roll is removed.

18 Claims, 12 Drawing Sheets

APPARATUS FOR OPENING COIN WRAPPERS

BACKGROUND OF THE INVENTION

1. Field of the Invention

The present invention relates generally to the field of paper and plastic cutting apparatus and devices and more particularly to devices for cutting or opening the wrapper on a roll of coins.

2. Background

People working in institutions such as banks, casinos, and retail stores that handle wrapped coin rolls in large volumes often have problems opening the rolls in an orderly fashion. Some solve the problem by cracking the roll against the edge of a solid object several times until the wrapper breaks or opens. However, this may often cause all the coins inside to spill out. Others may use a knife to attempt to cut the roll open, but this may nick or dull the knife and may also be awkward for some. In addition, if the cutting is done inexpertly, the coins can still spill out when the person attempts to remove them.

Still others may attempt to open the wrapped rolls by tearing at them with fingernails or jagged objects. All of these approaches can lead to spilled coins and wasted time. If the person attempting to open the roll is an employee of the institution, this is ultimately an added burden on payroll expense. If the person attempting to open the coin roll is a customer, such as a casino customer at a slot machine, for example, this can lead to lost revenues, since the time spent opening the roll and picking up any spills could be better spent in using the coins in the machine.

One attempt to solve this problem is described in U.S. Pat. No. 4,106,196 to Smithline, issued Aug. 15, 1978. There, a cutting device is shown that mounts a razor blade inside a body that permits a coin roll to be inserted inward against movable protective flaps or flanges and placed longitudinally so that the razor blade can be pressed down directly along the longitudinal outside wrapper of the coin roll. Razor blades or other cutting edges used in such a way tend to dull quickly as a result of the pressure ordinarily brought to bear to force the blade to cut. The pressure needed usually means that the sharp edge of the blade will be pushed directly through the wrapper and into the metal coins inside each time the device is used.

Other approaches using razor blades (U.S. Pat. No. 3,667,122 to Black, issued Jun. 6, 1972, U.S. Pat. No. 4,333,234 to Smith et al., issued Jun. 8, 1982 and U.S. Pat. No. 3,781,987 to Gentscheff, issued Jan. 1, 1974)) or straight edge blades (U.S. Pat. No. 4,040,183 to Cassier, issued Aug. 9, 1977, U.S. Pat. No. 4,086,698 to Sparks, issued May 2, 1978, U.S. Pat. No. 4,091,537 to Stevenson, Jr. issued May 30, 1978, and U.S. Pat. No. 3,965,575 to Stunger, issued Jun. 29, 1976) have similar problems. Straight edges aligned parallel to the coin roll, such as those of razor blades or straight edge blades used to cut through the wrapper by the application of force or pressure tend to quickly dull and need replacement. Some of these devices are complicated in structure, such as Gentscheff. Still others may have exposed cutting surfaces, such as Cassier.

U.S. Pat. No. 4,038,746 to Bromley, issued Aug. 2, 1977, discloses a keylike device that has a prong shaped to extend over the rim of a wrapped coin roll, so that the user can twist and rock the keylike device to tear the wrapper open. While this device has no cutting surface or blade, it would appear to require a force that many prospective users may be unable to apply.

It is an object of this invention to provide a coin wrapper opening device that is simple to use.

It is another object of the present invention to provide a coin wrapper opening device that is less likely to dull a cutting edge quickly.

Still another object of the present invention is providing a coin wrapper opening device that provides protection for the user's hands and fingers.

SUMMARY OF THE INVENTION

These and other objects are achieved by an apparatus for opening coin wrappers that has a surface with a curved or angled cutting edge fixed to it in such a way that the cutting edge faces away from the surface and projects away from it at a height and an angle that is effective to score or cut the wrapper of a wrapped roll of coins, when brought into cutting relationship with the wrapped roll of coins. In several embodiments the surface also includes a guidepath formed in it to extend in a direction in line with the cutting edge to guide wrapped coin rolls to the cutting edge. In one embodiment, the cutting edge is shielded by a protective resilient flap that pushes up and away when a wrapped coin roll passes the cutting edge, and then returns to its original shielding position when the wrapped coin roll is removed. In other embodiments, the cutting edge is shielded by a resilient strip fixed to the surface over the cutting edge in such a way that the resilient strip stands away from the cutting edge when no pressure is placed on it, and the resilient strip deforms to allow the cutting edge to pass through an aperture in the resilient strip when the apparatus is placed against a wrapped coin roll. In another embodiment, a combination of protective shields can be used, a resilient flap fitting over the cutting edge from the edge of the surface and a resilient strip fitting over the cutting edge from another area of the surface, as well. In another embodiment, a pair of wings, fixed to a spring mechanism can be used so that they part when a wrapped coin roll is placed in cutting relationship with the cutting edge and the wings fold over the cutting edge again when the coin roll is removed.

DETAILED DESCRIPTION OF PREFERRED EMBODIMENTS

Figure 1A:
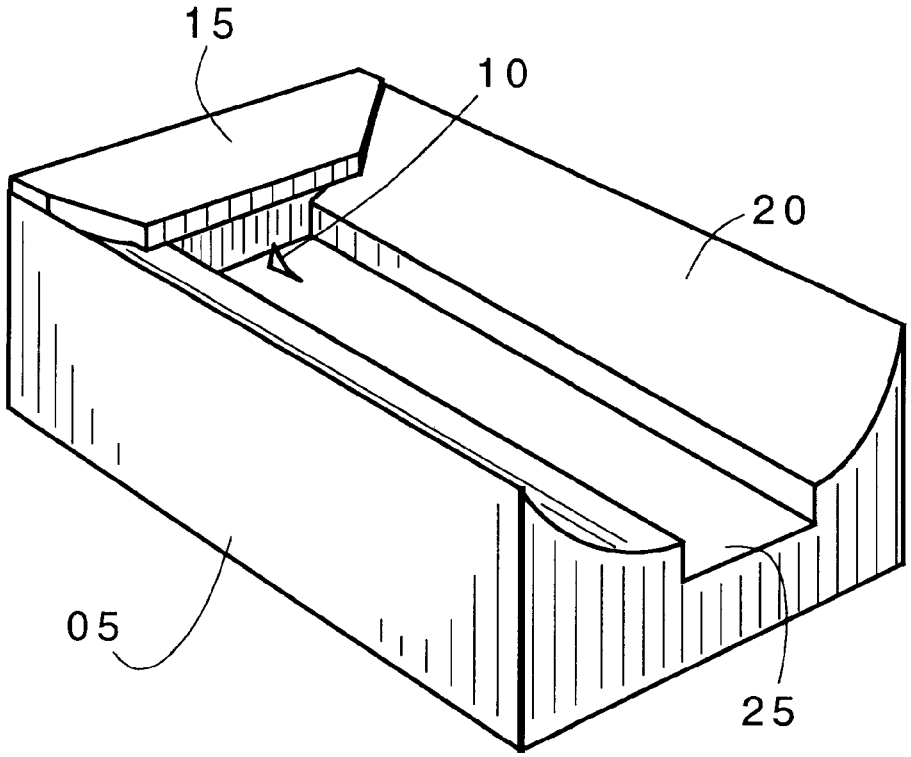
FIG. 1A is a perspective view of the interior of an embodiment of the present invention.

An interior perspective view of the embodiment of FIG. 1A shows wrapper opener 05 with a surface 20 that has a cutting edge 10 fixed to it in such a way that cutting edge 10 projects away from surface 20 and is aligned in a lengthwise direction of surface 20. In several embodiments, surface 20 is shaped and dimensioned to form a generally concave surface that will accommodate wrapped coin rolls of varying diameters. For coins minted in the United States of America, for example, these diameters might include those of the smallest coins, dimes, up to the largest coins typically used in casinos, five dollar pieces. As will be apparent to those skilled in the art, the dimensions can be varied to accommodate coins minted in other countries to other dimensions, or to accommodate special wrapped coins, tokens, chips, or similar objects having unique diameters.

In the embodiments of FIGS. 1A, 1B, 1C and FIG. 2A surface 20 is formed with a guidepath 25 extending through it lengthwise and in line with cutting edge 10, so as to guide a wrapped coin roll up to and along cutting edge 10. Guide path 25, when used in an embodiment, is preferably formed so that, for US minted coins, for example, it is one-half of an inch in width and is depressed one-eighth of an inch below the lowest internal point of surface 20. Similarly, in the embodiments of FIG. 1A, 1B, 1C and FIG. 2A, cutting edge 10 is fixed to or formed from the lowest internal point of guide path 25 and projects away from it, aligned in a lengthwise direction to guide path 25. In the embodiments of FIG. 1A, 1B, 1C and FIG. 2A, cutting edge 10 projects away from guide path 25 (or surface 20 when no guide path 25 is used, as in FIG. 2B) to a height of one-sixteenth of an inch, for US minted coins.

Figure 10:
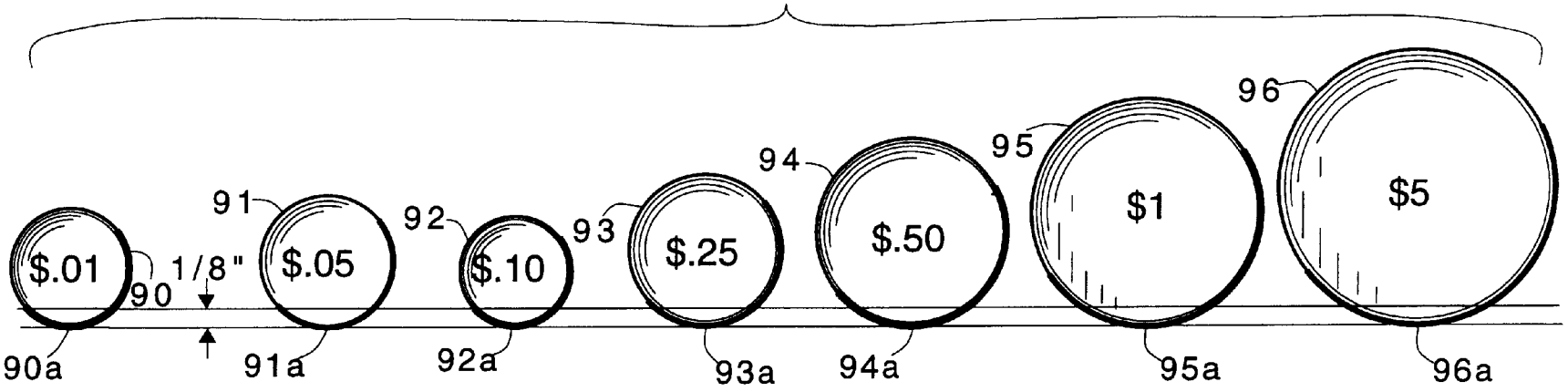
FIG. 10 is a front elevation of coins of different denominations showing the common dimensions at each coin's lowest point.

Turning briefly to FIG. 10, a series of US minted coins 90 through 96, of varying denominations and dimensions are shown. Coin 92, for example, is a 10 cent piece or dime, usually the US minted coin having the smallest diameter. At coin 92's lowest point an arc 92*a* is formed by that part of the coin that represents an area that will fit into a space of one-eighth of an inch in depth by one half an inch in width. Consequently, all or a part of each of the arcs 90*a* through 96*a*, of their respective coins, will fit into guide path 25 of the present invention.

In the embodiments of FIG. 1A, 1B, 1C and FIG. 2A, it can be seen that cutting edge 10 is positioned so that it does not protrude above guide path 25. In the embodiments shown in the embodiments of FIG. 1A, 1B, 1C and FIG. 2A, guide path 25 forms a partial protective surround for cutting edge 10, since cutting edge 10 is recessed within it.

Referring now to FIG. 1A, resilient flap 15 is formed at an edge of surface 20 in such a way as to extend over cutting edge 10, when no wrapped coin roll is inserted.

In this "closed" position, resilient flap 15 helps a user avoid cutting his or her hand or fingers on the device. In the embodiment of FIG. 1A, resilient flap 15 is formed so that it will move up and away from cutting edge 10 when a wrapped coin roll is pressed against it.

Figure 7:
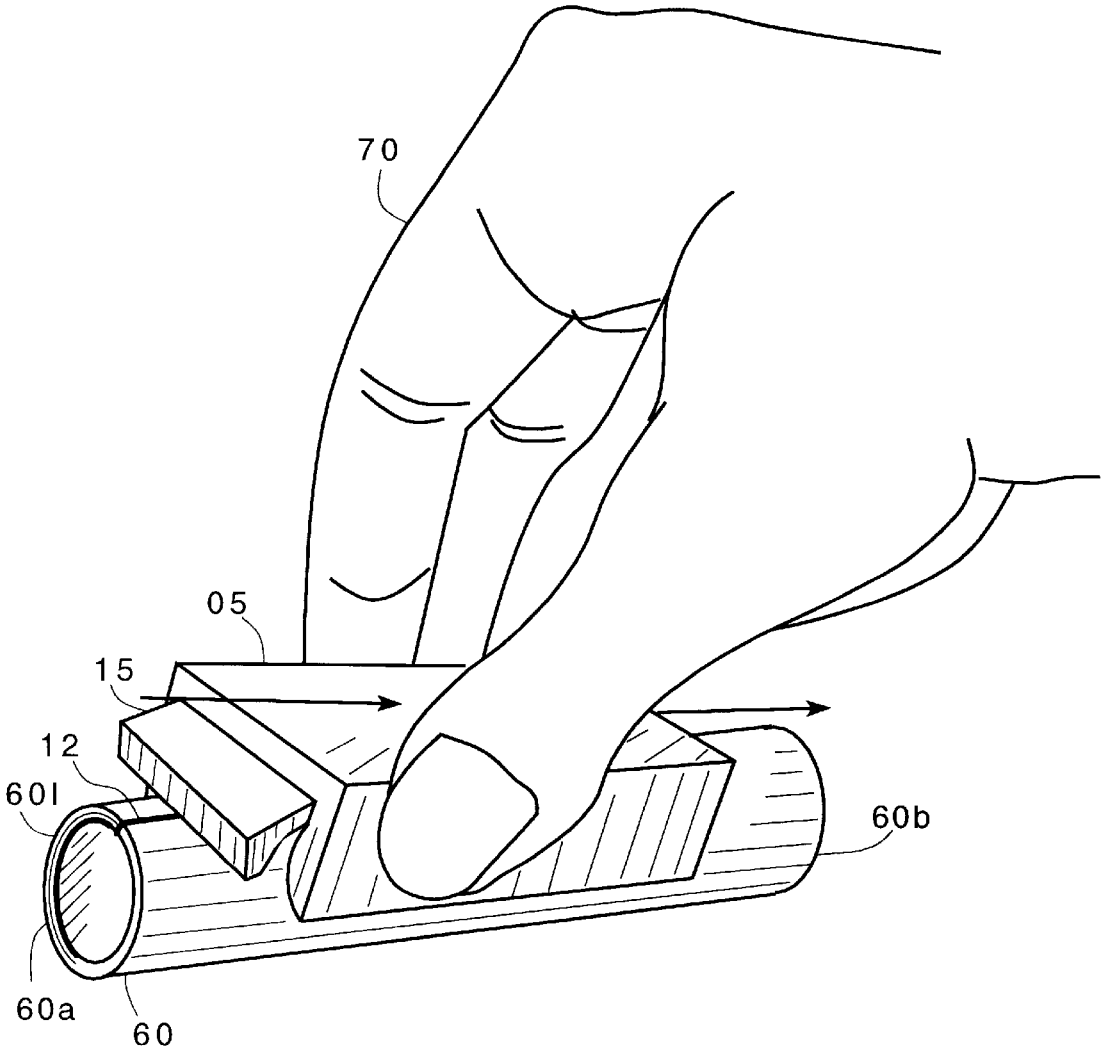
FIG. 7 is a perspective view showing a partial scoring of a wrapped coin roll by the present invention.

Turning briefly to FIG. 7, the embodiment of FIG. 1A is shown in use. In FIG. 7, wrapped coin roll 60 is being opened. The user holds wrapper opener 05 in his or her hand 70, and positions guide path 25 (not visible in this view) of wrapper opener 05 over the wrapped coin roll 60 and against the front portion 60*a* of wrapped coin roll 60. By pulling wrapper opener 05 towards the distal portion 60*b* of wrapped coin roll 60, the user causes the front portion 60*a* of wrapped coin roll 60 to come into a cutting relationship with cutting edge 10 while also pushing resilient flap 15 out and away from cutting edge 10, thus exposing cutting edge 10 to the coin wrapper.

Still in FIG. 7, after the user has pulled wrapper opener 05 along wrapped coin roll 60 for a few inches, it can be seen that a score 12 has been created by cutting edge 10. As shown in FIG. 7, this score 12 goes through the outer lip 601, of wrapped coin roll 60, as well as along the top of the wrapper.

Cutting edge 10 in the embodiments of FIGS. 1A, 1B, 1C and FIG. 2A, extends away from surface 20 or guidepath 25 at a height sufficient to effect the scoring shown in FIG. 7. As will be apparent to those skilled in the art, cuffing edge 10 can be positioned in one embodiment at a height effective to score a wrapper, and in another embodiment at a height effective to cut through a wrapper. In the embodiments of the present invention cutting edge 10 is an inclined cutting edge.

Figure 9A:
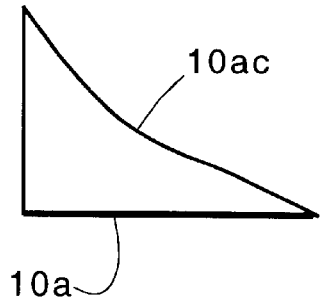
FIG. 9A is a cutting edge of the present invention in one embodiment.
Figure 9B:
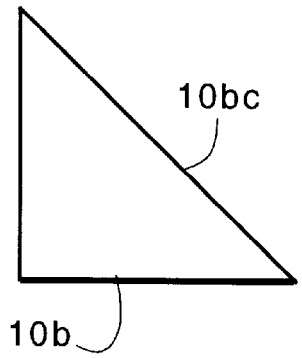
FIG. 9B is another cutting edge of the present invention in another embodiment.
Figure 9C:
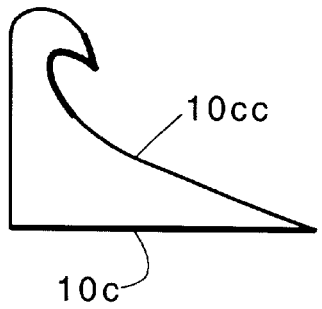
FIG. 9C is still another cutting edge of the present invention in another embodiment.

Now referring to FIG. 9A, a cutting edge 10*a* is shown in a side view, having a cutting surface 10*ac*, which is inclined inward to form a curve. In FIG. 9*b*, a cutting edge 10*b* is shown, having a cutting surface 10*bc* that is inclined at an even 45 degree angle. And in FIG. 9C, a cutting edge 10*c* is shown, having a cutting surface 10*cc* inclined in a curved form and having a hook-shape at one tip. The inclined surface of cutting edge 10 allows wrapper opener to be used on a variety of coin wrapper types.

Figure 8A:
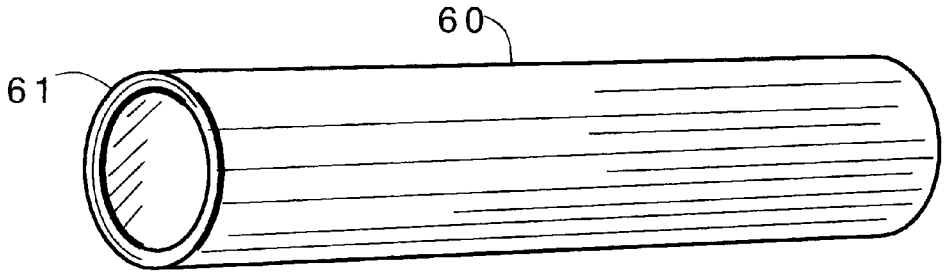
FIG. 8A is a perspective view of coins wrapped in a paper roll having a rounded lip at each end.
Figure 8B:
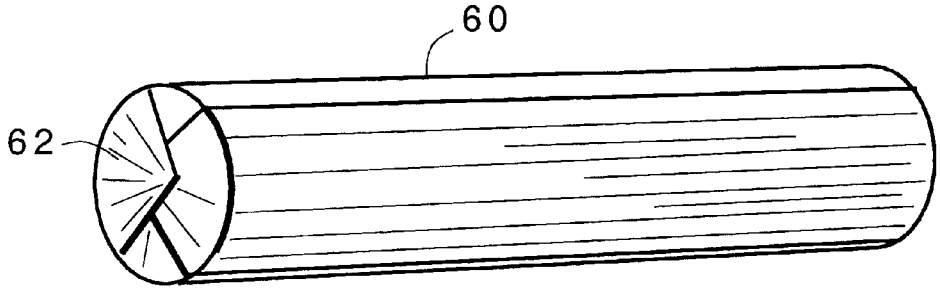
FIG. 8B is a perspective view of coins wrapped in a paper roll that folds at each end.
Figure 8C:
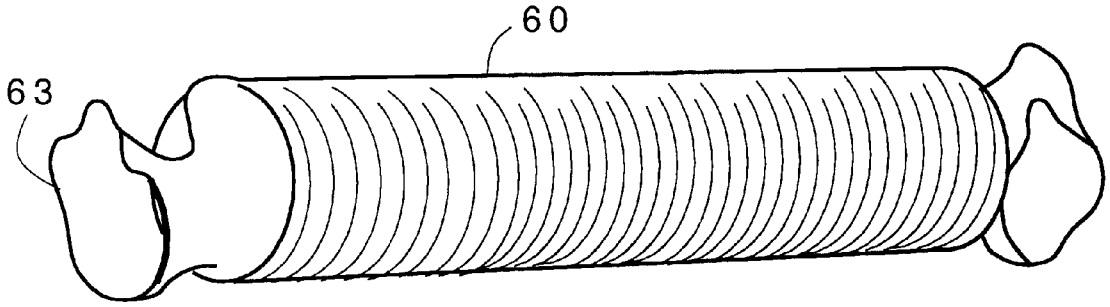
FIG. 8C is a perspective view of coins in a transparent plastic roll that shrink wrapped around them.

Referring now to FIGS. 8A, 8B, and 8C, three different types of coin wrappers are illustrated. In FIG. 8A, a wrapper having a rolled lip 61 is shown. FIG. 8B depicts a wrapper having a folded end 62. The wrappers of FIGS. 8A and 8B are usually made of heavy paper. In FIG. 8C, however, a plastic shrink—wrap wrapper 60 is shown, having open ends 63. The present invention is effective for opening all three types of wrappers.

Figure 1B:
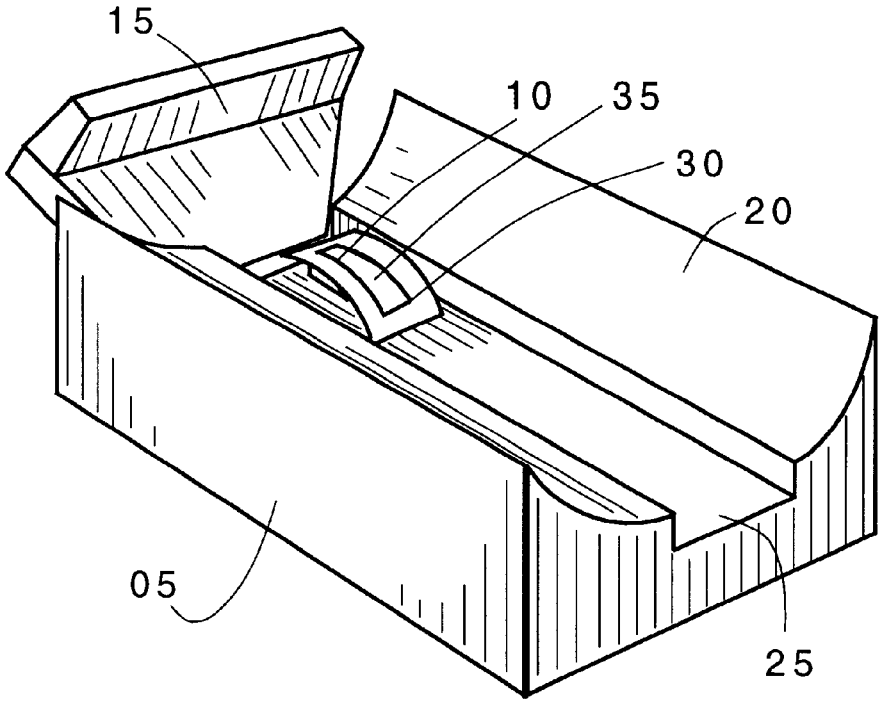
FIG. 1B is a perspective view of the interior of another embodiment of the present invention.

In the embodiment of wrapper opener 05 shown in FIG. 1A, it can be seen that a simple concave surface 20 is used, together with cutting edge 10 and resilient flap 15. The embodiment of FIG. 1B, by contrast, is similar to the embodiment of FIG. 1A, in that it also has a guide path 25, as well as surface 20, cutting edge 10 and resilient flap 15. However, the embodiment of FIG. 1B also has a resilient strip 30 which has an aperture 35 formed in it in such a way as to allow cutting edge 10 to extend through aperture 35 when resilient strip 30 is pressed downward and inward, usually in response to being placed in a cutting relationship with a wrapped coin roll. In the embodiment of FIG. 1B, both resilient flap 15 and resilient strip 30 serve to prevent a user's hand and fingers from coming into contact with cutting edge 10. In the embodiment of FIG. 1B, when the user places guide path 25 of wrapper opener 05 over the front portion 60*a* of a wrapped coin roll 60 and pulls wrapper opener 05 back along wrapped coin roll 60, resilient strip 30 is depressed downward by the pressure, thus exposing cutting edge 10 to wrapped coin roll 60 in cutting relationship. And, as with the embodiment of FIG. 1A, as wrapper opener 05 is pulled along wrapped coin roll 60, resilient flap 15 of the embodiment of FIG. 1*b* is pushed out and away from cutting edge 10.

Figure 1C:
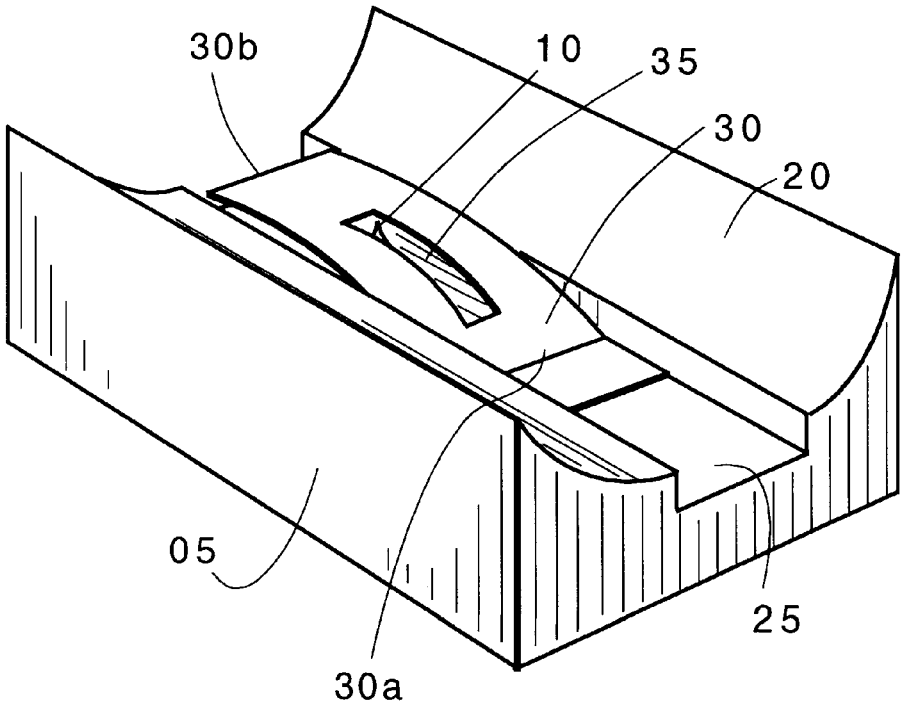
FIG. 1C is a perspective view of the interior of yet another embodiment of the present invention.

Now turning to the embodiment of FIG. 1C, it can be seen that wrapper opener 05 is formed having a surface 20, with a guide path 25 extending lengthwise through it, in line with a cutting edge 10. In the embodiment of FIG. 1C, a resilient strip 30 having an aperture 35 is used to cover cutting edge 10 when the device is not in use. This embodiment does not have a resilient flap 15. As can be seen in FIG. 1C, resilient strip 30 is fixed to guide path 25 at its distal end 30*a* and stands free of guide path 30 at the end 30*b* that is proximate to cutting edge 10. In the embodiments of both FIG. 1B and 1C, resilient strip 30 is formed in such a way that the area surrounding aperture 35 extends away from guide path 25 at a height sufficiently above cutting edge 10 so as to make it unlikely that cutting edge 10 will come into contact with hands or fingers.

Figure 1D:
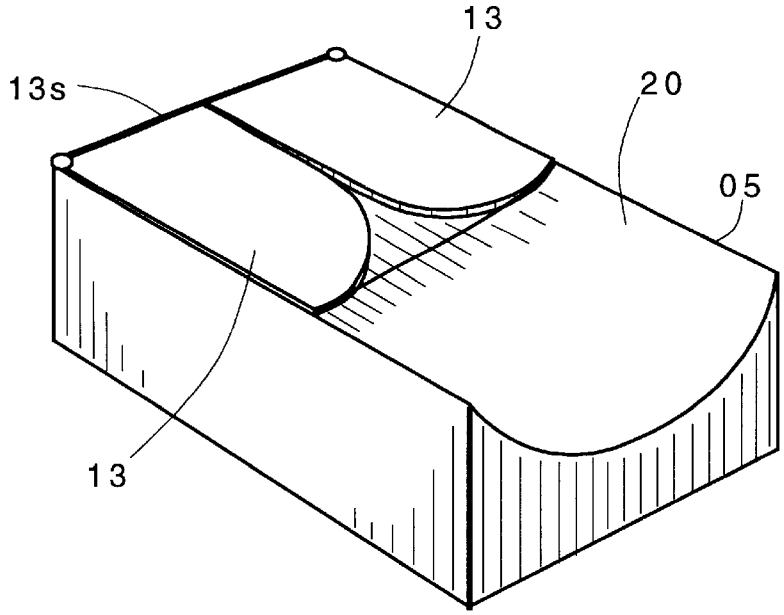
FIG. 1D is a perspective view of the interior of still another embodiment of the present invention, showing a cutting edge covered.
Figure 1E:
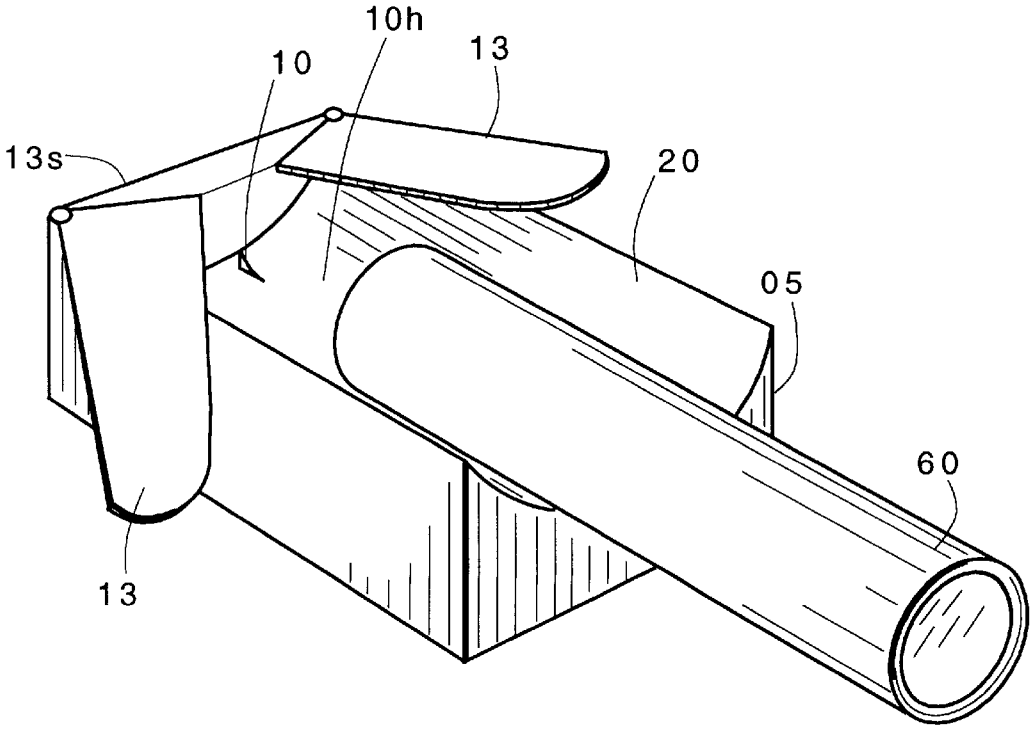
FIG. 1E is a perspective view of the interior or the embodiment of FIG. 1D, showing a cutting edge exposed.

The embodiment shown in FIGS. 1D and 1E shows yet another implementation in which the protective covering device is a pair of wings 13 spring-wire mounted to wrapper opener 05 by spring-wire mount 13*s* in such a way that when they are at rest, wings 13 return to close over cutting edge 10, forming a protective cover, as shown in FIG. 1D. When a wrapped coin roll 60 is placed on surface 20 and pushed against wings 13, as shown in FIG. 1E, wings 13 open to reveal cutting edge 10 so it can be placed in cutting relationship with wrapped coin roll 60. Still in FIG. 1E, wings 13, spring mount 13*s*, cutting edge 10 and cutting edge holder 10*h* might all be formed as part of a replaceable blade holder that can be attached to wrapper opener 05. As will be apparent to those skilled in the art, the embodiments shown in FIGS. 1A, 1B, 1C and 2A cutting edge 10 could also be assembled as part of a replaceable unit fitted into guide path 25 or as part of a replaceable subassembly of wrapper opener 05.

Figure 2A:
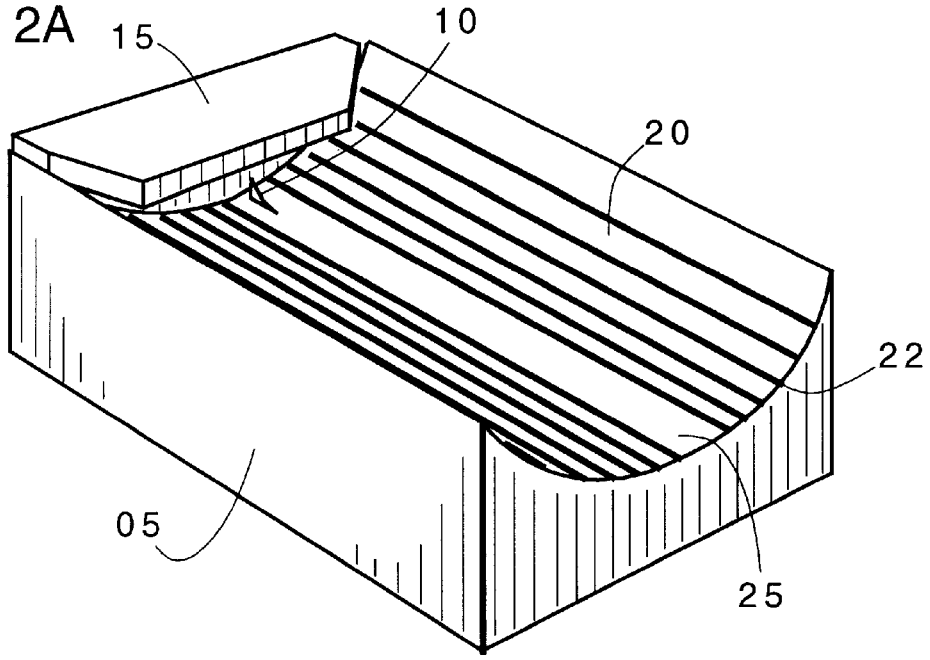
FIG. 2A is a perspective view of the interior of still another embodiment of the present invention.

Turning now to the embodiment shown in FIG. 2A, it can be seen that a variation of the embodiment of FIG. 1A is depicted. In the embodiment of FIG. 2A, wrapper opener 05 has a resilient flap 15, and a cutting edge 10, embedded in a guide path 25, that is part of a surface 20, which has ridges 22. In the embodiment of FIG. 2A, ridges 22 in surface 20 can be shaped and dimensioned to fit the various coin diameters more closely, so that all of surface 20 acts more like a guide.

Figure 2B:
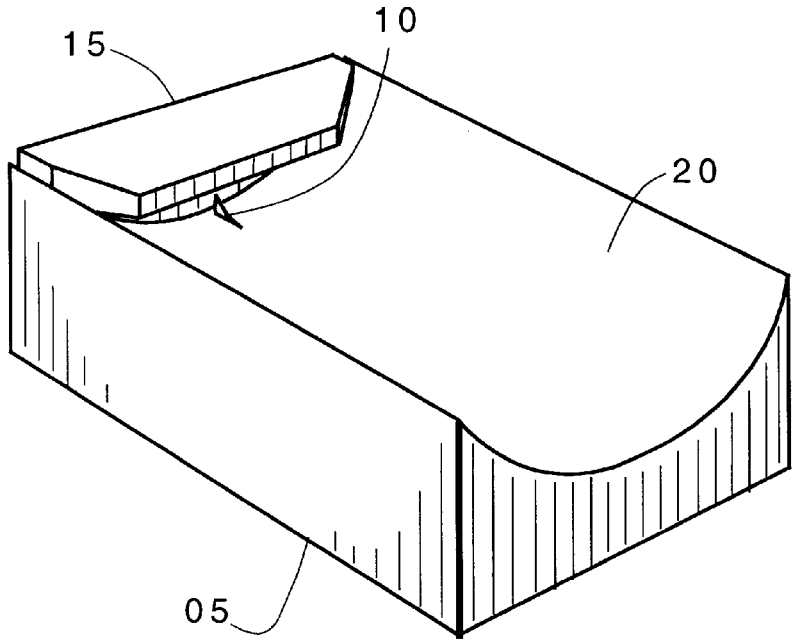
FIG. 2B is a perspective view of the interior of another embodiment of the present invention.

The embodiment of FIG. 2B is another variation of the embodiment of FIG. 1, in this case, one without a guide path 25.

Figure 2C:
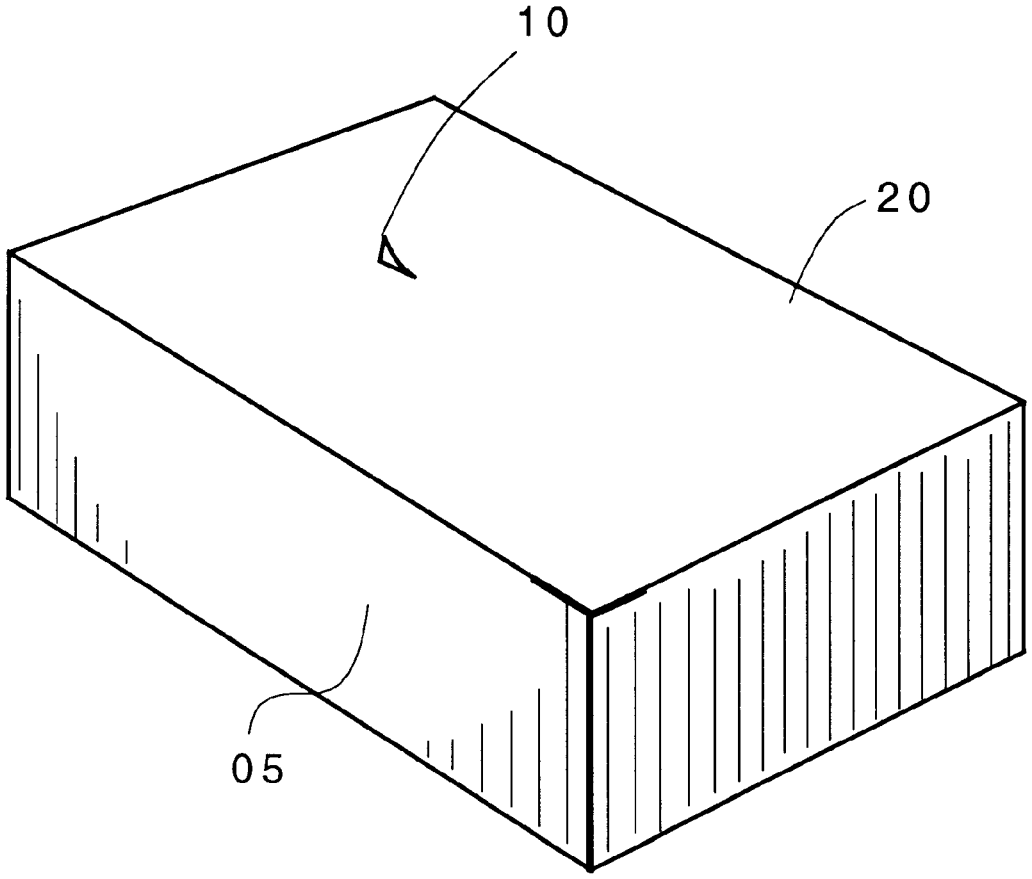
FIG. 2C is a perspective view of the interior of another embodiment of the present invention.

The embodiment of FIG. 2C shows the simplest components of the present invention, namely a surface 20 and a cutting edge 10 having an inclined angle at its cutting surface and projecting away from surface 20 at a height effective to score a wrapped coin roll. As will be apparent to those skilled in the art, the embodiments of FIGS. 2B and 2C might also have cutting edge 10 formed either as an integral part of surface 20 or as a replaceable subassembly thereof.

Figure 3:
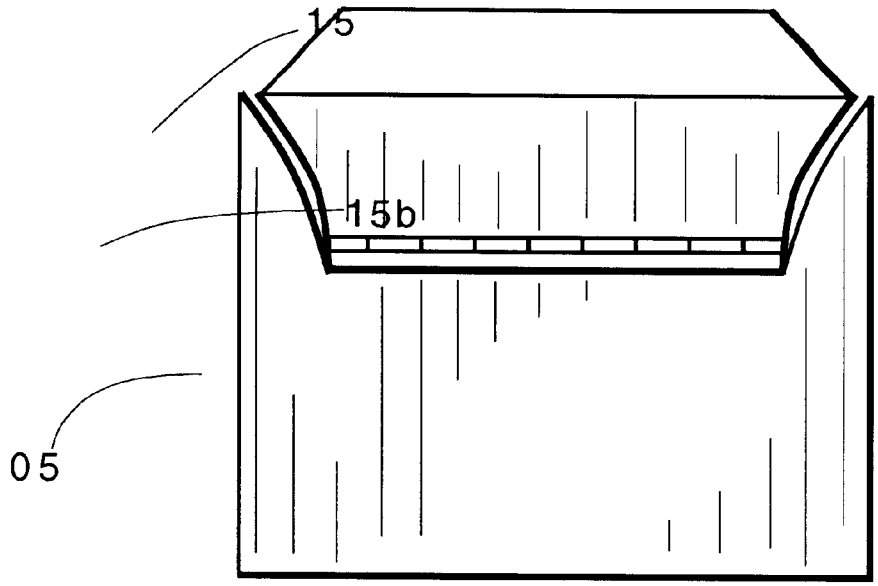
FIG. 3 is a perspective end view of a protective flap of the present invention embodiment.

With reference now to FIG. 3, an embodiment of wrapper opener 05 having a resilient flap 15 attached to it by hinge-like mechanism 15*b* is shown.

Figure 4:
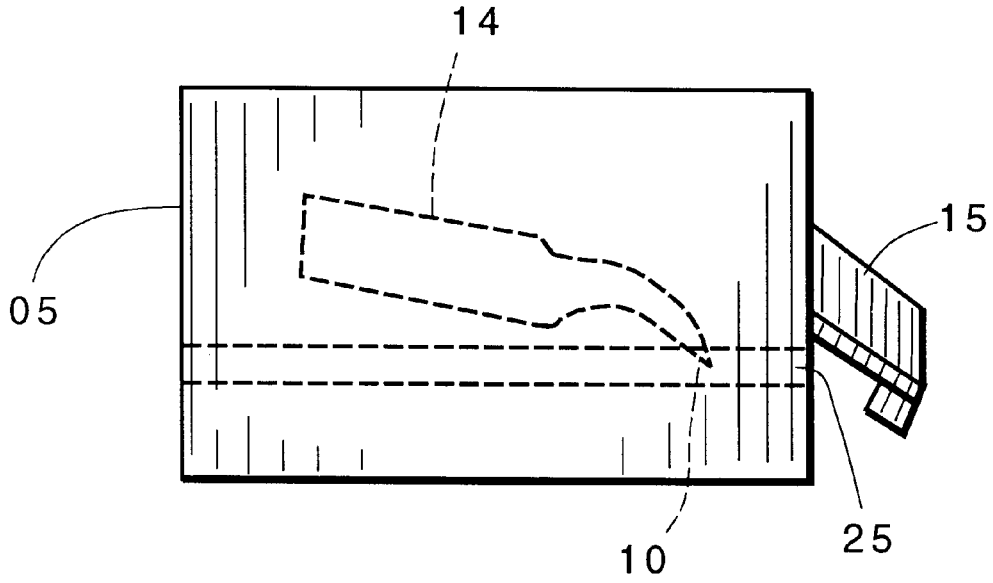
FIG. 4 is a cutaway view of a cutting edge inserted in a body of the present invention.

The embodiment of FIG. 4 shows a cutaway view of an alternative embodiment of FIG. 1, in which cutting edge 10 is part of a blade 14 embedded inside wrapper opener 05 in such a way that cutting edge 10 extends into guidepath 25.

The embodiments of FIGS. 1A, 1B, 1C, 1D, 1E, 2A, 2B, 2C, 3, 4, 5, 6, and 11 can be fashioned from a number of different materials, such as plastics, metals, wood, etc. For example, the embodiment of FIG. 1A could be made by injection molding or extrusion, with cutting edge 10 and resilient flap 15 formed as part of a unitary wrapper opener 05. Alternatively, the embodiment of FIG. 1A could be constructed from metal with cutting edge 10 bonded to wrapper opener 05, and resilient flap 10 attached to the body of wrapper opener 05 by a hinge-like mechanism. In other cases, the embodiment of FIG. 4 might have a surface 20 and resilient flap 15 made of plastic bonded to a cutting edge 10 of a metal blade 14, such as an EXACTO™ blade.

Figure 5:
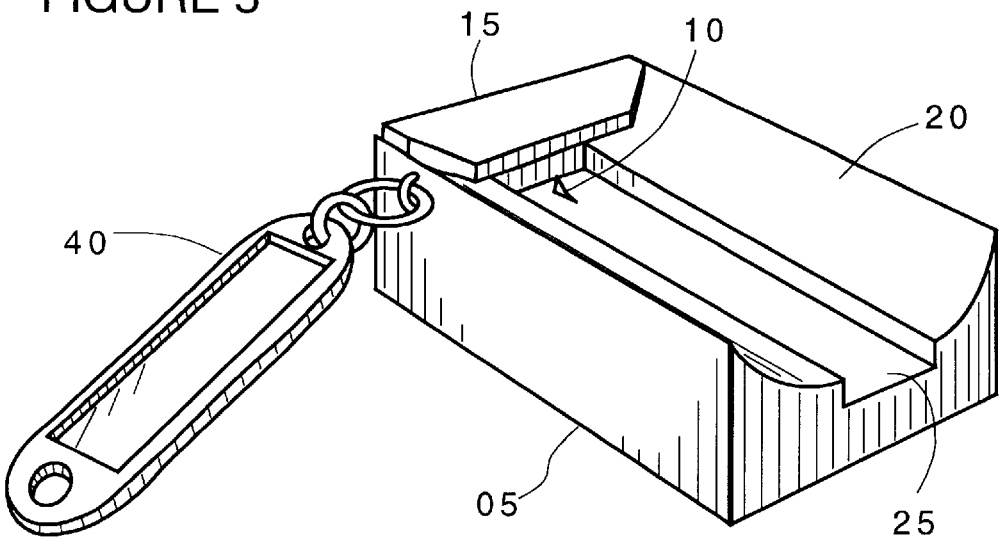
FIG. 5 is an interior perspective view of an embodiment of the present invention having a keychain attached.
Figure 6:
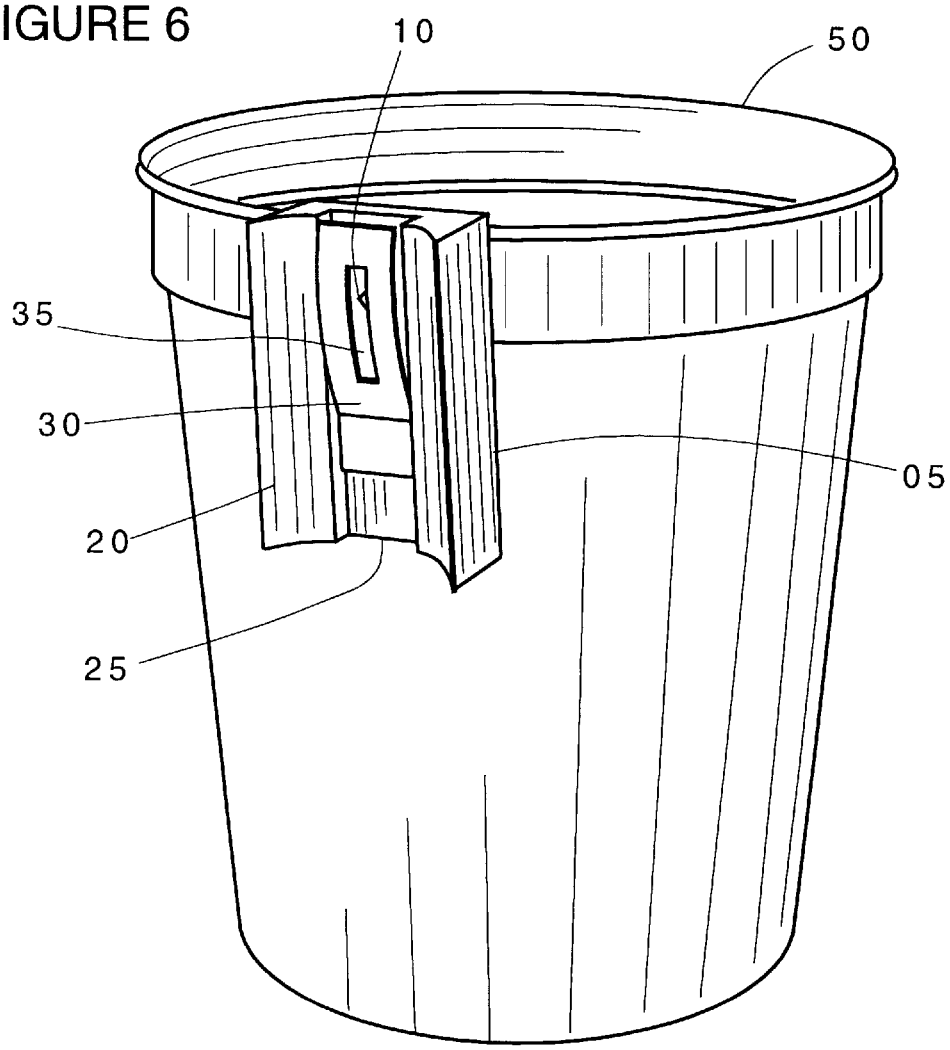
FIG. 6 is a perspective view of the present invention attached to a coin holder.

The embodiment of FIG. 5 might be constructed from molded plastic to which a keychain 40 or identifier tag or similar device has been added by means of a simple ring insert. In the embodiment shown in FIG. 6, a plastic container 50 such as those used by casinos might be formed with a wrapper opener 05 bonded or otherwise attached to its outer rim. As will be apparent to those skilled in the art, the present invention could also be manufactured or assembled with an number of other devices that server either to promote the establishment using it or serve a useful purpose such has the coin holder or keychain.

Figure 11:
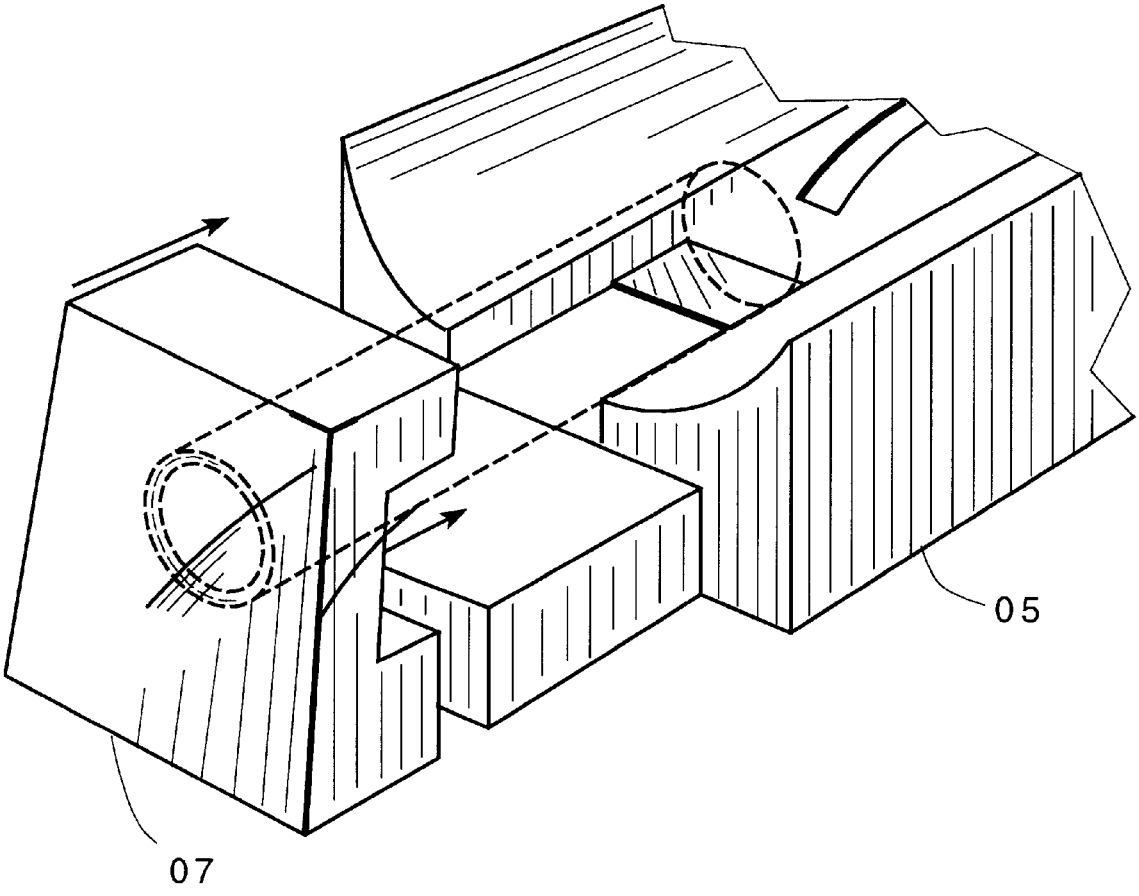
FIG. 11 is a perspective view of a motorized embodiment of the present invention.

A motorized embodiment such as that schematically depicted in FIG. 11 might also be constructed, so that wrapper opener 05 forms part of a mechanism that moves an arm 07 to push a wrapped coin roll into cutting relationship with cutting edge 10. As will be apparent to those skilled in the art, a number of additional means to provide a protective covering for cutting edge 10 could be used. For example, a clear, transparent plastic hood might be mounted over the area occupied by cutting edge 10. Alternatively, a motorized embodiment might be constructed much like an electric pencil sharpener, with the cutting edge completely obscured from view or touch. Similarly, in a motorized embodiment, a sensing mechanism might be included to sense the presence of a wrapped coin roll when inserted and cause impelling arm 07 to push the roll into cutting relationship.

Those skilled in the art will appreciate that the embodiments described above are illustrative only and that other systems in the spirit of the teachings herein fall within the scope of the invention.

What is claimed is:

1. An apparatus for cutting open the wrapper of a wrapped coin roll, comprising:

a major surface having a proximate and a distal end;

a cutting edge, projecting away from the major surface at a height sufficient to engage with the lip of the wrapper of a wrapped coin roll and cut therethrough and the cutting edge also positioned near the proximate end of the major surface; and a movably mounted surface connected to the major surface perpendicular to the line of cutting and in protective relationship above the cutting edge when the apparatus is not being used for cutting open the wrapper of a wrapped coin roll, the movably mounted surface having an abutment end such that as a wrapped coin roll is moved across the major surface into cutting relationship with the cutting edge, the wrapped coin roll comes into contact with the abutment end of the movably mounted member and moves it from its protective position as the wrapped coin roll moves cross the cutting edge, so that the movably mounted member moves generally in the direction of the cutting edge, yet maintaining its spaced apart relationship;

so that the wrapper of the wrapped coin roll is cut for removal from the roll as such wrapped coin roll is moved across the surface.

2. The apparatus of claim 1, wherein the movably mounted surface further comprises a member extending laterally with respect to the proximate end of the surface.

3. The apparatus of claim 1, wherein the cutting edge further comprises a cutting edge having a face that is curved and shaped to extend above the major surface at a height that is generally sufficient to engage with the edge of the wrapped coin roll and cut through the paper thereof.

4. The apparatus of claim 1, wherein the curved face of the cutting edge is formed in the shape of a hook.

5. The apparatus of claim 2, wherein the movably mounted member is a resilient flap formed at an end of the major surface that is proximate to the cutting edge, providing a protective cover for the cutting edge, whereby the resilient flap is pushed up and away from the cutting edge when a wrapped roll of coins is moved in a cutting relationship with the cutting edge, and the resilient flap springs back to its original position when the coins are removed.

6. The apparatus of claim 5, wherein the resilient flap is formed as an integral part of the major surface.

7. The apparatus of claim 5, wherein the resilient flap is hinged to the major surface.

8. The apparatus of claim 5, wherein the resilient protective flap is fastened by a spring means to the surface.

9. The apparatus of claim 2, wherein the protective device further comprises a resilient strip having an aperture therethrough, the resilient strip being fixed to the surface in such a way that the resilient strip stands away from the cutting edge at a height effective to cover the cutting edge when the apparatus is not in use and the resilient strip deforms in a generally downward direction when the apparatus is put into relationship with a wrapped coin roll, thereby permitting the cutting edge to protrude through the aperture of the resilient strip to form a cutting relationship with the wrapper of the wrapped coin roll.

10. The apparatus of claim 9, wherein the protective device further comprises a resilient flap formed at the end of the surface that is proximate to the cutting edge, providing a second protective cover for the cutting edge, whereby the resilient flap is pushed up and away from the cutting edge and the resilient strip is deformed in a generally downward direction when a wrapped roll of coins is moved in a cutting relationship with the cutting edge, and the resilient flap and the resilient strip spring back to their respective original positions when the coins are removed.

11. The apparatus of claim 2, wherein the protective device further comprises a pair of wings extending above the surface and in a direction generally parallel to the surface, and fixed to a spring mechanism attached to the end of the surface that is proximate to the cutting edge in such a way that the wings are pulled into a generally parallel relationship with each other to form a covering over the cutting edge when the apparatus is not in use, and the wings are parted from each other in the horizontal plane as a wrapped coin roll is placed into cutting relationship with the cutting edge, in such a way that the cutting edge is exposed.

12. The apparatus of claim 1, wherein the major surface is concave.

13. The apparatus of claim 11, wherein the cutting edge is fixed at the lowest point of concavity of the surface.

14. The apparatus of claim 1, wherein the surface is shaped in a generally concave form by a plurality of stepped ridges extending along the surface.

15. The apparatus of claim 1, wherein the major surface further comprises a guidepath formed along it and including within it the cutting edge in such a way that the guidepath guides a wrapped coin roll in a direction aligned with the cutting edge to help place the wrapped coin roll in a cutting relationship with the cutting edge.

16. The apparatus of claim 15, wherein the guidepath further comprises a groove in the major surface, the groove having a depth that is twice the height of the cutting edge and having a width which allows an arcuate portion of wrapped coin rolls of a plurality of sizes to fit within it.

17. The apparatus of claim 1, wherein the surface further comprises a motorized impelling arm located at the distal end of the surface from the cutting edge, such that the motorized impelling arm can push a wrapped coin roll along the surface to bring it into cutting relationship with the cutting edge.

18. The apparatus of claim 1, wherein the cutting edge is formed as part of a replaceable subassembly fitted into the major surface.

* * * * *